United States Patent [19]

Engel et al.

[11] Patent Number: 4,952,755

[45] Date of Patent: Aug. 28, 1990

[54] SAFETY PLATE FOR ELECTRICAL OUTLET

[76] Inventors: Stephen M. Engel, 512 North Highland; Wallace W. Weiger, 1005 West 2nd, both of Pierre, S. Dak. 57501

[21] Appl. No.: 378,089

[22] Filed: Jul. 11, 1989

[51] Int. Cl.[5] ..... H01R 13/447

[52] U.S. Cl. ..... 174/67; 439/136

[58] Field of Search ..... 174/67; 220/242; 439/136, 145

[56] References Cited

U.S. PATENT DOCUMENTS

| | | | |
|---|---|---|---|
| 2,477,803 | 8/1949 | Huber | 439/137 |
| 2,710,382 | 6/1955 | Fitzpatrick et al. | 439/137 |
| 3,068,442 | 12/1962 | Kubik et al. | 439/136 |
| 3,222,631 | 12/1965 | Cohen | 439/137 |
| 3,865,456 | 2/1975 | Dola | 439/137 |
| 4,094,569 | 6/1978 | Dietz | 439/137 |
| 4,600,258 | 7/1986 | Hu | 439/140 |
| 4,640,564 | 2/1987 | Hill | 439/137 |
| 4,798,916 | 1/1989 | Engel et al. | 174/67 |

FOREIGN PATENT DOCUMENTS 2256558 7/1975 France .

*Primary Examiner*—Leo P. Picard
*Assistant Examiner*—David A. Tone

[57] ABSTRACT

A safety plate for electrical outlets includes a cover plate having apertures therein for receiving the prongs of an electrical plug. A pair of slidable panels also having apertures for the prongs of a plug, are mounted to the back of the cover plate, and are held in place by a back plate. The back plate has a pair of holes therethrough corresponding to the receptacles of an electrical wall outlet, so as to allow a close fit between the receptacles and the slidable panels. A spring biases the panels so as to misalign the panel apertures with the cover plate apertures, such that there is no direct opening between the cover plate apertures and the receptacle apertures. A tab projects from each slidable panel through an opening in the side of the cover plate, to allow the user to push each independent panel against the bias of the spring and align the panel apertures with the cover plate apertures, and thereby allow insertion of an electrical plug therethrough into the receptacle apertures. A gasket along the back perimeter of the cover plate seals any air leaks.

5 Claims, 2 Drawing Sheets

SAFETY PLATE FOR ELECTRICAL OUTLET

TECHNICAL FIELD

The present invention relates generally to safety covers for electrical outlets, and more particularly to an outlet cover with manually slidable panels having apertures for the prongs of an electrical plug.

BACKGROUND OF THE INVENTION

Since the introduction of electrical power in the home, there has always been a problem of safety—especially where children are present. The earliest outlets for electrical power were simply open sockets into which an appropriate device could be screwed to accept the contact prongs of the plug attached to an appliance. This arrangement was used because there was, at that time, direct current systems, which required appropriate polarity.

Later, when alternating current became the overwhelming choice, the electrical outlets were designed having receptacles into which the two prongs of an appliance could be put. Safety was considerably enhanced by these sockets. More recently, outlets for receiving three prong plugs have been used. The third aperture is simple a ground connection to enhance safety for the general user. However, there is no improvement in blocking direct contact with the power source.

The principal problem with two- and three-prong outlets, is that children frequently poke safety pins, paper clips or the like into the electrical outlet holes. Obviously, this sort of exploration can have disastrous results.

One method of overcoming such a problem, was the introduction of plastic dummy plug. Such a plug is formed to be inserted into the outlet in a manner similar to an appliance plug. However, because the dummy is made up of an insulating plastic, the prongs simply fill the two apertures and cover the rest of the outlet so that pins or wires cannot be inserted to engage the contacts. Such devices work reasonably well until one or more of the dummy plugs is misplaced or broken.

It is also a problem with prior art cover plates to change or match the color of the existing receptacle. If the outlet is old, the color of the dummy plug may not precisely match, or even be available. In those safety outlets which have a panel that slides over the receptacle apertures, it is still possible to see the receptacle through the apertures of the cover plate. Thus, a homeowner desiring a change in the color of the cover plate would be forced to completely replace the receptacle, even if the prior art cover plates were used. Furthermore, the choice of receptacle colors is currently quite limited, and would thereby limit the choice of cover plate colors as well.

The applicants' previous patent, U.S. Pat. No. 4,798,916, was one attempt to overcome these problems. While the applicants, previous patent was a substantial improvement over prior art devices, it was necessary to insert the prongs into the slidable plate and force the slidable plate to one side in order to insert a plug into an outlet. This operation can be difficult in some instances.

It is therefore a general object of the present invention to provide an improved safety plate for an electrical outlet.

Another object is to provide a safety plate which allows the use of oversize plugs.

Yet another object of the present invention is to provide a safety plate with panels which cover the outlet apertures, the panels being slidable but not removable from the safety plate.

Still another object of the present invention is to provide a safety plate which completely covers the existing receptacle, so that it cannot be seen whether in use or not in use.

These and other objects will be apparent to those skilled in the art.

SUMMARY OF THE INVENTION

A safety plate for electrical outlets is disclosed which includes a cover plate having apertures therein for receiving the prongs of an electrical plug. A pair of slidable panels also having apertures for the prongs of a plug, are mounted to the back of the cover plate and are held in place by a back plate. The back plate has a pair of holes therethrough corresponding to the receptacles of an electrical wall outlet, so as to allow a close fit between the receptacle apertures and the slidable panels. A spring biases the panels so as to misalign the panel apertures with the cover plate apertures, such that there is no direct opening between the cover plate apertures and the receptacle apertures. A tab projects from each slidable panel, through an opening in the side of the cover plate, to allow the user to push each independent panel against the bias of the spring so as to align the panel apertures with the cover plate apertures and thereby allow insertion of an electrical plug therethrough into the receptacle apertures. A gasket along the back perimeter of the cover plate seals any air leaks.

DESCRIPTION OF THE PREFERRED EMBODIMENTS

Figure 2:
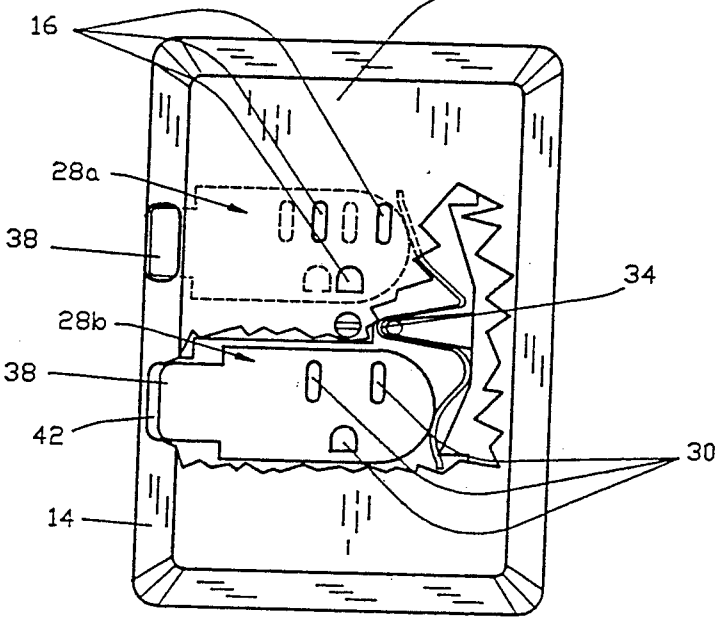
FIG. 2 is a front elevational view with a portion broken away to expose inner details.
Figure 1:
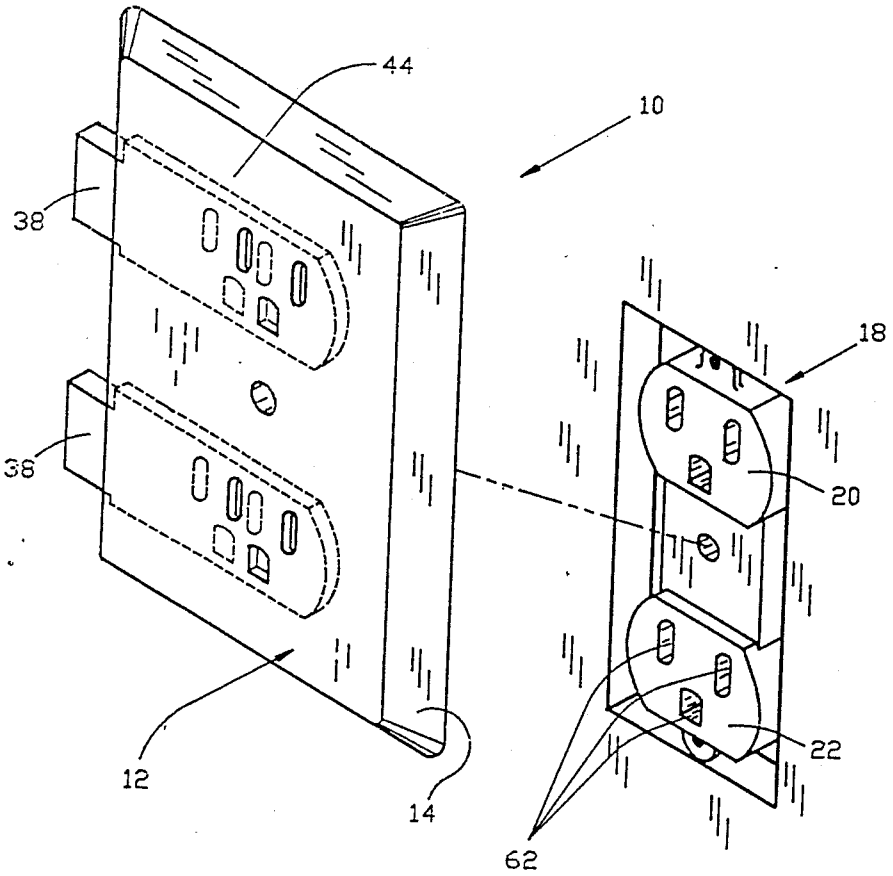
FIG. 1 is a perspective view of the invention shown exploded from a wall outlet.

Referring now to the drawings, in which similar or corresponding parts are identified by the same reference numeral, the safety plate of the present invention is referred to generally at 10 and includes a front cover plate 12 having a rearwardly projecting lip 14 around its perimeter and a plurality of apertures 16 therethrough which correspond with the prongs of a three-pronged plug. Cover plate 12 has the same dimensions as a conventional outlet cover and is adapted to fasten over a wall outlet 18 having upper and lower receptacles 20 and 22 respectively.

Figure 4:
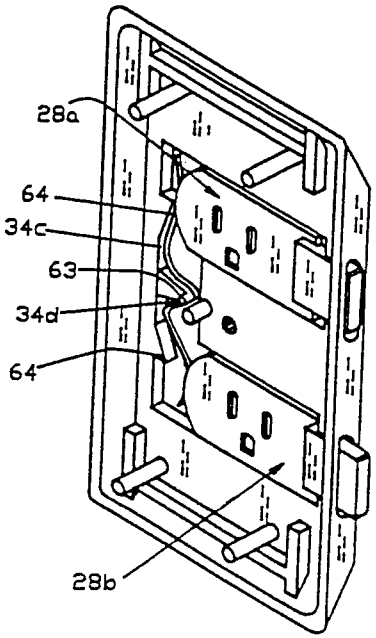
FIG. 4 is a rearward perspective view of the invention, with the back panel removed to expose details.
Figure 3:
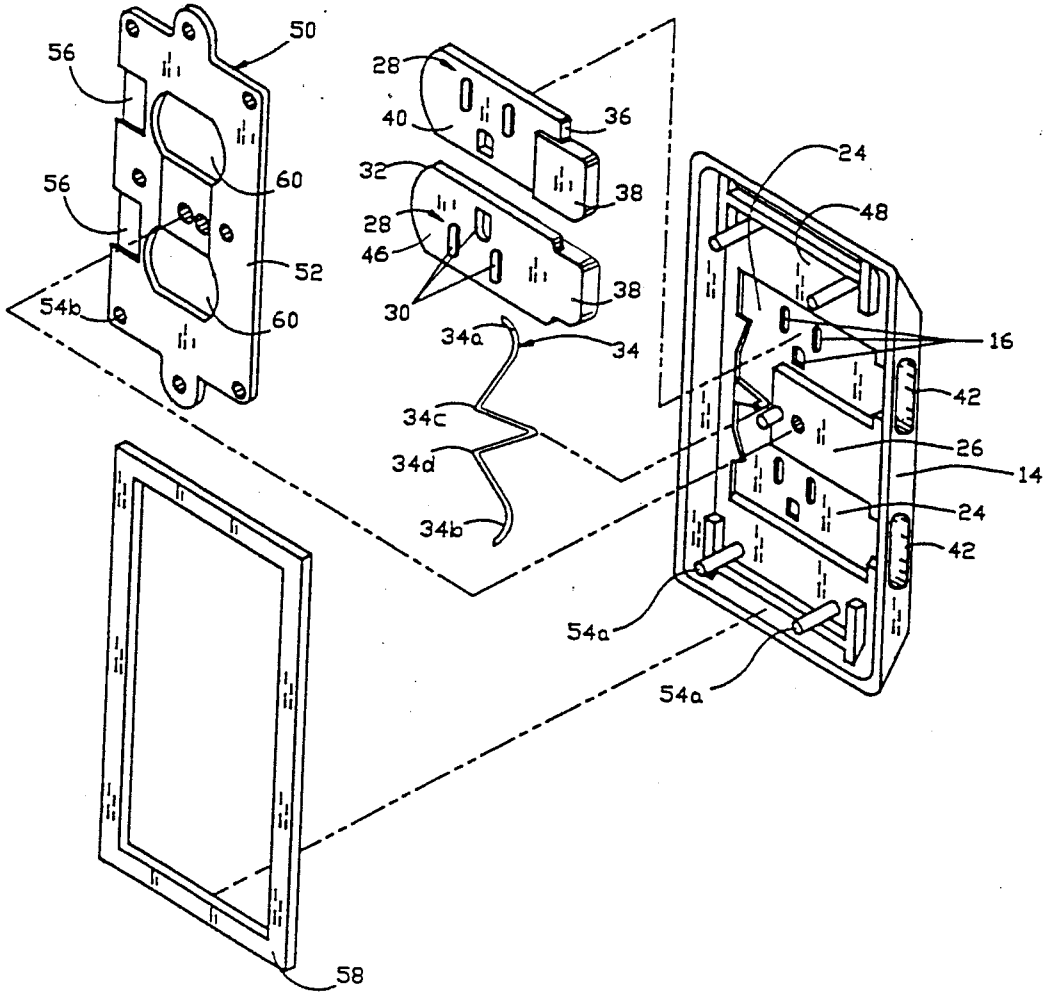
FIG. 3 is an exploded rearward perspective view of the invention.

Referring to FIG. 3, the back of cover plate 12 has a pair of generally rectangular depressions 24 therein which surround apertures 16. Depressions 24 are substantially separated by a narrow strip 26. A pair of panels 28 slide horizontally within depressions 24 as shown in FIGS. 2 and 4. Panels 28 have apertures 30 therein which correspond with the prongs of a three-prong plug. One side edge 32 is arcuate, and will abut a spring 34, so as to bias each panel 28 to slide in one direction within depression 24. The side edge 36 opposite to arcuate side edges 32 has a tab 38 projecting therefrom. Tab 38 projects slightly from the rearward surface 40 of each panel 28, and longitudinally outwardly therefrom, so as to extend into a notch 42 formed in lip 14 on front cover plate 12. Thus, panels 28 have a forward surface 46 which slides flush along the rearward surface 48 of front cover plate 12 within depressions 24, the apertures 30 in panels 40 being selectively aligned with apertures 16 in front cover plate 12.

A back plate 50 has a flat forward facing surface 52 (see FIG. 3) which covers depressions 24 so as to slidably hold panels 28 within depressions 24. Back plate 36 is snapped in place using peg-in-aperture combinations **54*a* and 54*b*. Back plate 50 has a length and width less than that of cover plate 12, and a thickness less than the depth of lip 14, such that it will fit within the back of cover plate 12. A pair of depressions 56 in the forward surface 52 of back plate 50 correspond with tabs 38 on panels 28 and will slidably receive tabs 38. Thus, when back plate 50 is snapped into position on cover plate 12, panels 28 will slide between back plate 50 and cover plate 12, and tabs 38 will slide within the depressions 56 in the forward surface of back plate 50**.

A gasket 58 of thermal insulating material is affixed within the perimeter of lip 14, and has a thickness great enough to project out the back of cover plate 12, beyond lip 14. Gasket 58 is held in position by pegs **54*a* extending through back plate 50, gasket 58 being journaled between pegs 54*a* and lip 14. Gasket 58 is a resilient material, such that upon fastening plate 12 over an outlet 18, the gasket 58 will be sealably compressed against the wall. In this way, cold air within the wall cannot escape around the perimeter of cover plate 12**.

Back plate 50 also has a pair of holes 60 therein which are located so as to receive receptacles 20 and 22 when cover plate 12 is fastened to a wall outlet 18. When panels 28 are biased to one side by spring 34, panel apertures 30 are out of alignment with receptacle apertures 62 as well as cover plate apertures 16, thereby sealing cover plate apertures 16 from allowing cold air to escape therethrough.

Back plate 50 also serves to completely hide the receptacles 20 and 22 from being seen through the apertures 30 in panels 28. This eliminates the need for the consumer to remove and change the existing receptacles 20 and 22 if the color cannot be matched with the cover plate 10 or if it desired to change the color of the outlet.

Referring now to FIG. 3, it can be seen that spring 34 serves to bias both panels 28 horizontally so as to misalign the panel apertures 30 from the front plate apertures 16. A peg 63, in combination with the edge 64 of the depressions 24, is used to hold spring 34 in position, and to relieve the biasing strain from each half **34*a* or 34*b* of spring 34 from affecting the biasing of the other half of the spring. It can therefore be seen that sliding upper panel 28*a* against spring half 34*a* will cause spring 34 to first pivot about peg 63, and then bend at bend 34*c* against depression edge 64. This biasing action is thus kept from transmitting to spring half 34*b* by the bend around peg 63. Likewise, spring half 34*b* pivots about peg 63 and bends at bend 34*d*** in a similar manner and with similar results.

Spring 34 is therefore bent in a general W shape with portions **34*a* and 34*b* forming the outer legs, and the bend about peg 63 forming the central bridge. Each outer leg 34*a* and 34*b* is bent arcuate in a direction opposite to the arcuate portions 32 of panels 28**. These abutting arcuate surfaces assist in eliminating the possibility of the panel catching during sliding. A smooth and more reliable biasing and sliding action thereby occurs.

To use safety plate 10, cover plate 12 is fastened in the usual manner to a conventional outlet 18. The normal position of panels 28 is shown by panel **28*a* in FIG. 2 and panel 28*b* in FIG. 4. In this normal position, panel 28*a* is biased by leg 34*a* of spring 34 to the location in which the panel apertures 30 do not register with cover plate apertures 16**. Thus, it would be impossible for anything such as a wire, safety pin, or the like to be inserted into the apertures in the receptacle to make electrical contact with the power source.

When it is desired to engage a plug with the outlet 18, tab 38 is pushed against the biasing force of spring 34 as shown by panel **28*b* in FIG. 2, so as to move panel 28*b* slightly to the right until the panel apertures 30 are registered with the cover plate apertures 16. The prongs of the plug may then be inserted 0 into the receptacle. Upon removal of the plug from the receptacle, panel 28 will spring back to its normal position under the bias of spring 34, and receptacles 20 and 22** will again be covered to prevent insertion of material by children.

Whereas the invention has been shown and described in connection with a preferred embodiment thereof, it will be understood that many modifications, substitutions and additions may be made which are within the intended broad scope of the appended claims.

I claim:

1. A safety cover plate for an electrical wall outlet of the type having a pair of receptacles, each receptacle having apertures therein for receiving the prongs of an electrical plug, comprising:

a cover plate having apertures therein corresponding to the apertures in said receptacles, for receiving the prongs of an electrical plug, said apertures located so as to be aligned with receptacle apertures when the cover plate is fastened to a wall outlet;

said cover plate having a front surface, rearward surface, and a rearwardly projecting lip extending around the perimeter thereof;

the rearward surface of said cover plate having a pair of depressions therein for receiving slidable panels and a biasing means, the depressions surrounding the apertures in said cover plate;

a pair of panels slidably mounted for horizontal movement in the depressions in said cover plate;

each said panel having a tab projecting from one end thereof;

said cover plate further including a pair of spaced-apart notches formed through a portion of said lip, oriented to slidably receive said tabs;

said panels having apertures therein corresponding to the apertures in said cover plate;

said panels mounted for slidable movement between an operable position wherein the panel apertures are aligned with the cover plate apertures, and a storage position wherein said panel apertures are misaligned from the cover plate apertures;

biasing means connected to the rearward surface of said cover plate adapted to bias said panels from their operable position to their storage position; and means for removably attaching said cover plate to a conventional outlet.

2. The cover plate of claim 1, further comprising a back plate having a pair of holes therethrough corresponding with said outlet receptacles and oriented to receive said receptacles when the cover plate is attached to the outlet, said back plate fastened to the rearward surface of said cover plate, and enclosing said slidable panels and biasing means with said depressions in the cover plate.

3. The safety plate of claim 1, wherein said biasing means is a spring means having upper and lower ends, the upper end being positioned to bias against one side edge of the upper slidable panel, and said spring means lower end being positioned to bias against one side edge of the lower slidable panel.

4. The safety plate of claim 3, wherein said biased side edge of said panels is arcuate, and wherein the upper and lower ends of said springs means are bent arcuate in the opposite direction of said panel arcuate portions, such that an arcuate portion of the spring abuts the arcuate portion of the panel throughout the slidable extent of said panels.

5. The safety panel of claim 3, wherein said spring means includes an upper half and a lower half, said spring means being mounted for independent biasing of said upper and lower spring halves.

* * * * *